US007510076B2

(12) United States Patent
Yamada et al.

(10) Patent No.: US 7,510,076 B2
(45) Date of Patent: Mar. 31, 2009

(54) CASE

(75) Inventors: Shiro Yamada, Osaka (JP); Toshihiko Fujihara, Nara (JP)

(73) Assignee: Panasonic Corporation, Osaka (JP)

( * ) Notice: Subject to any disclaimer, the term of this patent is extended or adjusted under 35 U.S.C. 154(b) by 167 days.

(21) Appl. No.: 11/573,621

(22) PCT Filed: Dec. 28, 2005

(86) PCT No.: PCT/JP2005/024068

§ 371 (c)(1),
(2), (4) Date: Feb. 12, 2007

(87) PCT Pub. No.: WO2006/073108

PCT Pub. Date: Jul. 13, 2006

(65) Prior Publication Data

US 2007/0221522 A1 Sep. 27, 2007

(30) Foreign Application Priority Data

Jan. 5, 2005 (JP) ..... 2005-000372

(51) Int. Cl.
*B65D 85/38* (2006.01)

(52) U.S. Cl. ..... 206/316.2; 206/751; 224/251; 224/908; 224/930

(58) Field of Classification Search ... 206/316.1–316.3, 206/736, 751, 752, 755–760, 766, 774, 45.2–45.23; 150/106, 154, 162; 224/249–251, 908, 909, 224/910, 930
See application file for complete search history.

(56) References Cited

U.S. PATENT DOCUMENTS 5,064,109 A * 11/1991 Caster ..... 224/908
6,305,537 B1 * 10/2001 Jaffe ..... 206/316.2

(Continued)

FOREIGN PATENT DOCUMENTS

JP 2-111127 U 9/1990

(Continued)

OTHER PUBLICATIONS

International Search Report from the corresponding PCT/JP2005/024068, mailed Mar. 28, 2006.

*Primary Examiner*—Luan K Bui
(74) *Attorney, Agent, or Firm*—Hamre, Schumann, Mueller & Larson, P.C.

(57) ABSTRACT

The present invention relates to a case that can house an image pickup apparatus or the like and can be used as a cover of the image pickup apparatus for preventing the adhesion of water droplets to the image pickup apparatus during shooting. The case according to the present invention a first cover portion 20 and a second cover portion 21, and an outer periphery of the first cover portion has the same length as an outer periphery of the second cover portion. The first cover portion and the second cover portion change between a first state where the outer peripheries of the first cover portion and the second cover portion are joined to each other so as to provide a space inside and a second state where the outer peripheries of the first cover portion and the second cover portion are separated from each other with the outer peripheries being partially fixed to each other so that the outer peripheries as a whole assume a substantially T-shape.

14 Claims, 17 Drawing Sheets

U.S. PATENT DOCUMENTS 6,568,576 B1 * 5/2003 Godshaw et al. ..... 224/930
6,899,255 B2 * 5/2005 Pringle ..... 224/908

FOREIGN PATENT DOCUMENTS

JP 9-3041693 U 9/1997
JP 10-165216 * 6/1998
JP 2004-128529 4/2004
JP 2004-344565 12/2004

* cited by examiner

CASE

This application is a 371 of PCT/JP05/24068 filed Dec. 28, 2005.

TECHNICAL FIELD

The present invention relates to a case. In particular, the present invention relates to a case that can house an image pickup apparatus such as a video camera and can protect the image pickup apparatus from water droplets etc. when shooting is performed in the rain.

BACKGROUND ART

An image pickup apparatus such as a video camera mostly is used outdoors, and hence, it has frequent chances to encounter rain or snow during shooting. When shooting is performed under such circumstances, water droplets adhere to the image pickup apparatus, which may result in the failure of the image pickup apparatus itself.

In light of the above-described problem, products as shown in Patent Document 1 and Non-Patent Document 1 appeared on the market. Patent Document 1 discloses a case configured so as to cover the entire image pickup apparatus by housing it in a transparent case, thus preventing the adhesion of water droplets etc. coming from the outside to the image pickup apparatus. Non-Patent Document 1 discloses a cover (a "snow/rain jacket ") that can cover a video camera as an example of the image pickup apparatus from the top, so that the video camera equipped with the cover can avoid the adhesion of water droplets when it rains etc. as much as possible.

According to the configurations disclosed in Patent Document 1 and Non-Patent Document 1, shooting with the image pickup apparatus can be performed even in a light rain etc.

Patent Document 1: JP 2(1990)-111127 U

Non-Patent Document 1: "snow/rain jacket" appearing on page 30 of Union Catalog of Digital Video Camera (issued in October 2003) of Matsushita Electric Industrial Co., Ltd.

DISCLOSURE OF INVENTION

Problem to be Solved by the Invention

However, the configurations disclosed in Patent Document 1 and Non-Patent Document 1 merely house the image pickup apparatus when it rains or snows so as to prevent the adhesion of water droplets to the image pickup apparatus. Thus, when carrying the image pickup apparatus in a housed state, it is necessary to provide a separate case that can house the image pickup apparatus (e.g., a "soft bag" or a "soft case" appearing on page 30 of Non-Patent Document 1). This deteriorates the portability of the image pickup apparatus.

Furthermore, when the video camera is equipped with the snow/rain jacket as shown in Non-Patent Document 1, the user cannot use a display portion (having a liquid crystal display of about 2 to 4 inches and provided on the video camera so that it can be opened/closed), which is provided on the video camera together with a view finder. Thus, the snow/rain jacket as shown in Non-Patent Document 1 is inferior in terms of usability.

Therefore, with the foregoing in mind, it is an object of the present invention to provide a case that has excellent portability and improved usability so that it allows an image being shot etc. to be recognized visually through a view finder and a liquid crystal display portion of an image pickup apparatus.

Means for Solving Problem

In order to solve the above-described problem, the present invention provides a case for an image pickup apparatus including: a first cover portion; and a second cover portion. An outer periphery of the first cover portion has the same length as an outer periphery of the second cover portion. The first cover portion and the second cover portion change between a first state where the outer peripheries of the first cover portion and the second cover portion are joined to each other so as to provide a space inside and a second state where the outer peripheries of the first cover portion and the second cover portion are separated from each other with the outer peripheries being partially fixed to each other so that the outer peripheries as a whole assume a substantially T-shape.

Effects of the Invention

The case according to the present invention has excellent portability and improved usability so that it allows an image being shot etc. to be recognized visually through a view finder and a liquid crystal display portion of an image pickup apparatus, when the case is in the form of housing the image pickup apparatus, for example.

BRIEF DESCRIPTION OF DRAWINGS

FIG. 1 is a perspective view showing the appearance of a case according to an embodiment of the present invention.

FIG. 2 is a perspective view showing a surface side of the case that is in an open state.

FIG. 3 is a perspective view showing a rear surface side of the case that is in the open state.

FIG. 4 is a perspective view of the case with a fastener being opened.

FIG. 5 is a perspective view of the case with the fastener being opened.

FIG. 6 is a perspective view showing main components of a wrist fixing portion.

FIG. 7 is a perspective view showing the main components of the wrist fixing portion.

FIG. 8 is a perspective view showing the main components of the wrist fixing portion.

FIG. 9 is a perspective view showing the state where shooting is performed with a video camera housed in the case.

FIG. 10 is another perspective view showing the state where shooting is performed with the video camera housed in the case.

FIG. 11 is still another perspective view showing the state where shooting is performed with the video camera housed in the case.

FIG. 12 is a perspective view showing a surface side of a case that is in an open state.

FIG. 13 is a perspective view showing a surface side of a case that is the open state.

FIG. 14 is a perspective view of the case shown in FIG. 13.

FIG. 15 is a front view showing the state where a video camera body is supported by a supporting member.

FIG. 16 is a perspective view showing the state before an auxiliary container is attached to the case.

FIG. 17 is a perspective view showing the state where the auxiliary container is attached to the case.

EXPLANATION OF REFERENCE NUMERALS

Figure 1:
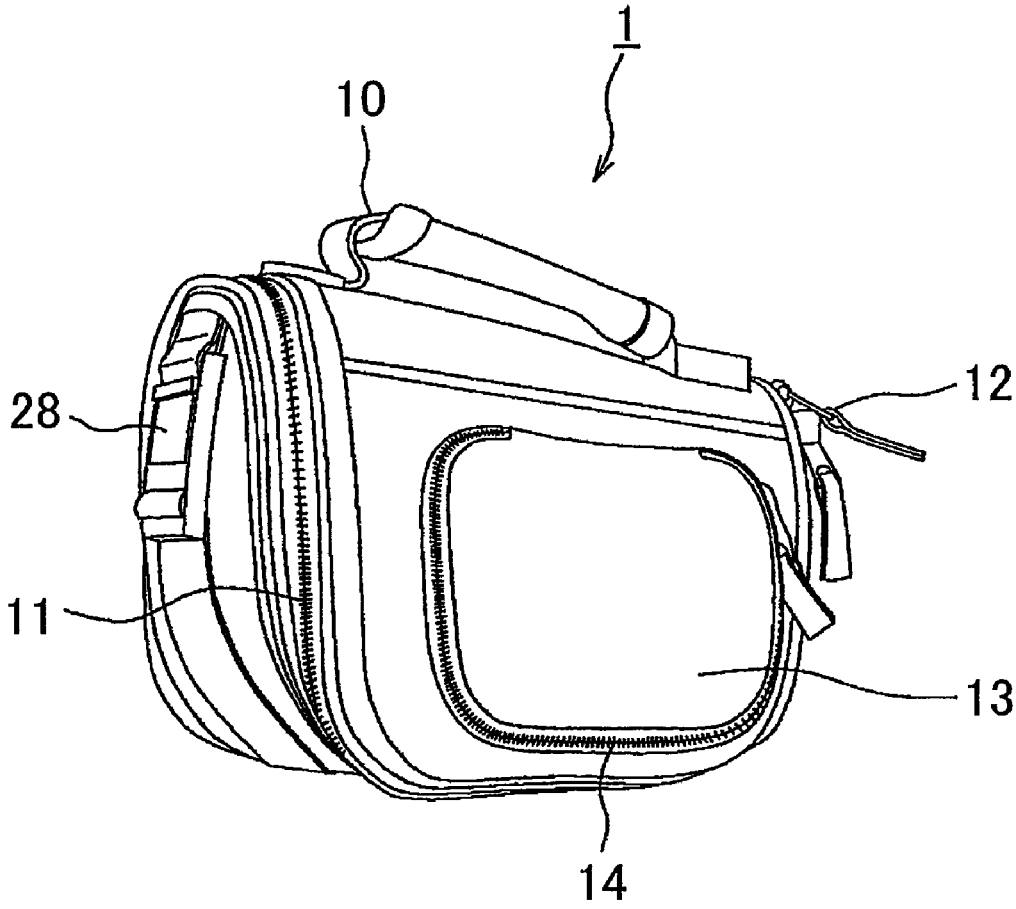
[FIG. 1]

1 case
2 opening portion
10 handle
11, 14 fastener
11*a*, 11*b* pair of fastener components
12 slider
13 lid
20 case upper part first cover)
21 case bottom part (second cover)
22, 24 rib
23, 26 button
25 screw (holding member)
27 ring
28 belt
30 video camera body
30*a* lens barrel
32 wrist fixing portion
33 display portion
41 belt (supporting member)
42 screw housing member (housing member)
43 lens barrel supporting member
50 auxiliary container

DESCRIPTION OF THE INVENTION

The image pickup apparatus to which the case according to the present invention is applicable may be configured so that it includes: a front surface where a lens through which an optical image enters is exposed; a rear surface facing the front surface; a first side surface connected to the front surface and the rear surface; a second side surface facing the first side surface; and an upper surface and a bottom surface that are connected to the front surface, the first side surface, and the second side surface. The image pickup apparatus can be housed in the space of the case.

The case may be configured so that, in the first state, the first cover portion covers at least the upper surface and the second cover portion covers at least the lens. With this configuration, it is possible to realize a case that can house an image pickup apparatus and has excellent portability.

Furthermore, the second cover portion may be configured so that it can change between the second state and a third state in which the second cover portion is wrapped around an arm or a portion near the arm of an operator of the image pickup apparatus. With this configuration, the case can be held at the arm or near the arm of the user reliably, so that shooting can be performed with the image pickup apparatus being stabilized.

Still further, the first side surface or the second side surface may have a display portion that reproduces the optical image that has entered through the lens, and the first cover portion may have an opening portion through which the optical image reproduced by the display portion can be recognized visually in the second state or the third state at a position corresponding to the display portion. With this configuration, it becomes possible to perform shooting while visually recognizing the display portion (e.g., a large liquid crystal monitor of about 2 to 4 inches) of the image pickup apparatus.

Still further, the case may be configured so that it further includes a lid that covers the opening portion and is partially fixed to the first cover portion. The lid can be opened/closed with respect to the first cover portion and covers an upper part of the display portion when the lid is opened with respect to the first cover portion. With this configuration, it becomes possible to perform shooting while visually recognizing the display portion (e.g., a large liquid crystal monitor of about 2 to 4 inches) of the image pickup apparatus and also to protect the display portion from water droplets when it rains, for example.

Still further, the case may be configured so that the first cover portion includes a holding member that can hold the image pickup apparatus. With this configuration, it becomes possible to position the image pickup apparatus relative to the case in any of the first state, the second state, and the third state, thus reducing the chances of the image pickup apparatus being damaged by being dropped etc. during the change from the first state to the second state, for example.

Still further, the case may be configured so that the first cover portion includes a housing member that can house the holding member. With this configuration, it becomes possible to prevent an inner surface of the case or the image pickup apparatus from being damaged by the holding member such as a screw.

Still further, the case may be configured so that a grip portion that can be gripped so as to hold the first cover portion and the second cover portion in a suspended manner is provided on a surface of the first cover portion facing a bottom surface of the second cover portion in the first state.

Still further, the case may be configured so that the first cover portion comprises a supporting member that supports the first cover portion. With this configuration, in the second state, the conformity of the first cover portion with the external shape of the image pickup apparatus is improved, which allows the image pickup apparatus to be held stably.

Still further, the case may be configured so that the first cover portion includes a lens barrel supporting member that supports a lens barrel of the image pickup apparatus. With this configuration, the lens that is built in the lens barrel can be arranged relative to the case stably.

Still further, the case may be configured so that an attachment member with which a second case is engaged in a detachable manner is provided on an outer surface of the second cover. With this configuration, it becomes possible to carry a battery, a tape cassette, etc. easily by putting them in the second case.

EMBODIMENT 1

Hereinafter, the case according to the present invention will be described by way of embodiments, in which a video camera case is referred to as an example of the case of the present invention as in the "Background Art" section above.

Figure 2:
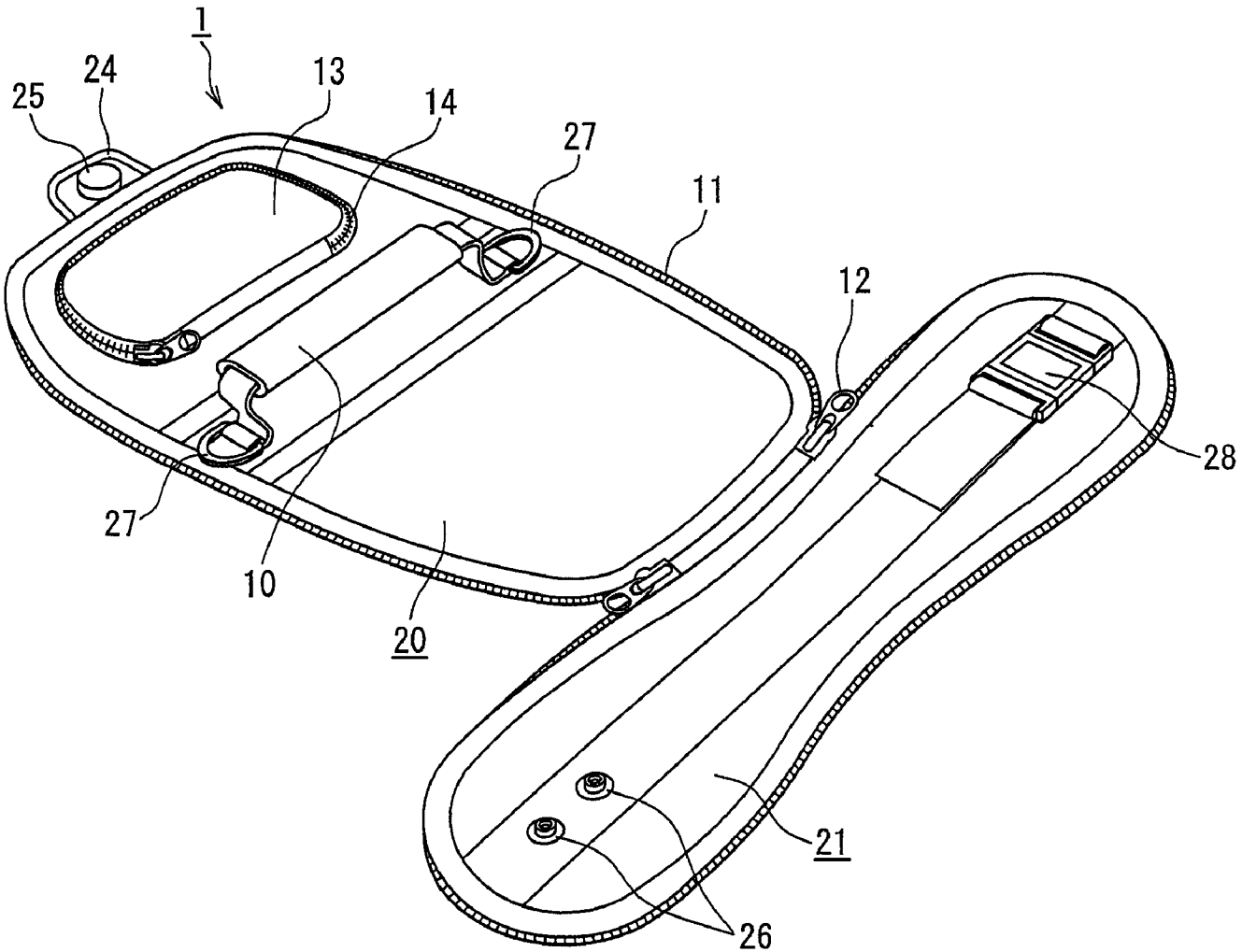
[FIG. 2]
Figure 3:
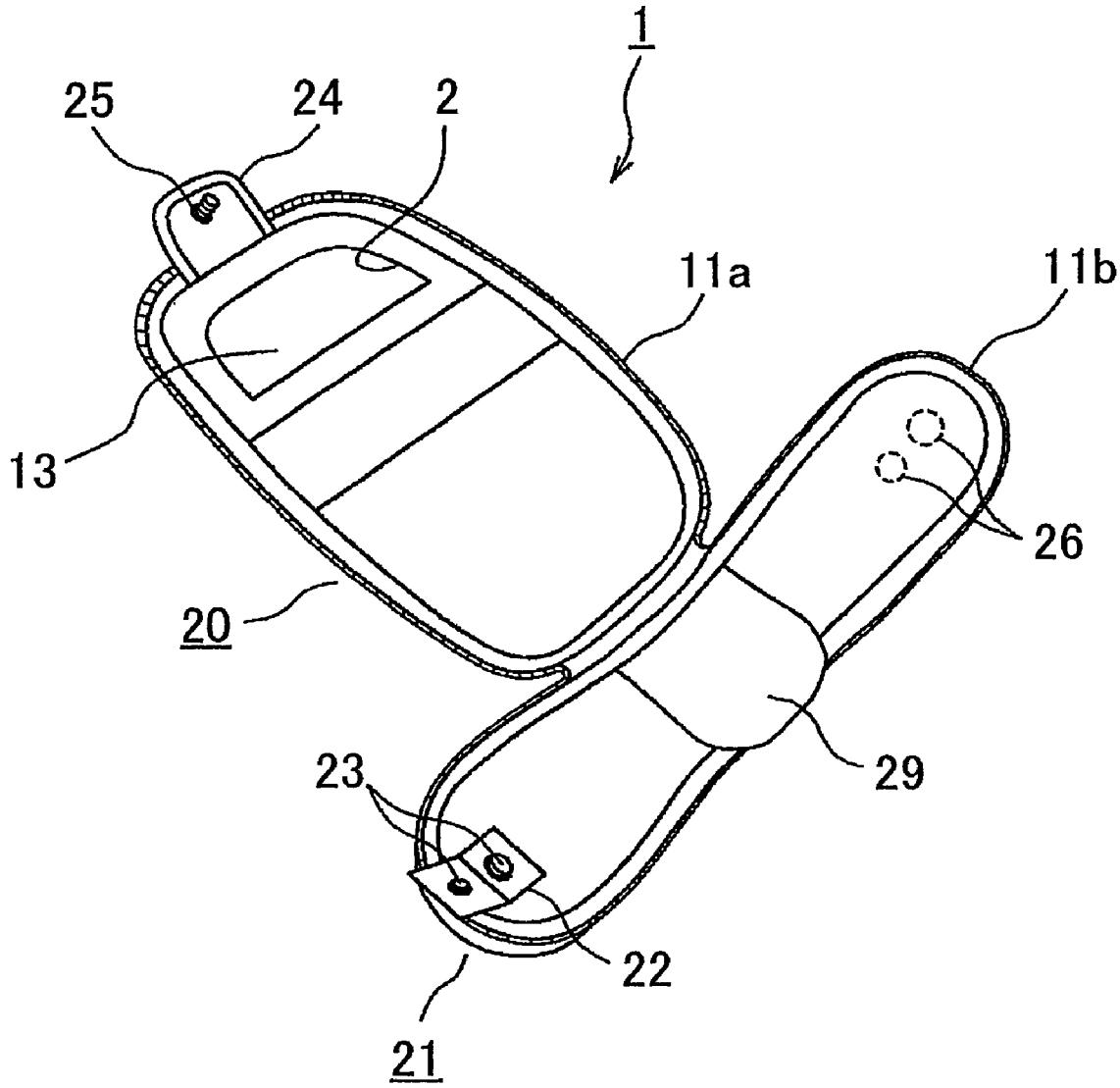
[FIG. 3]
Figure 4:
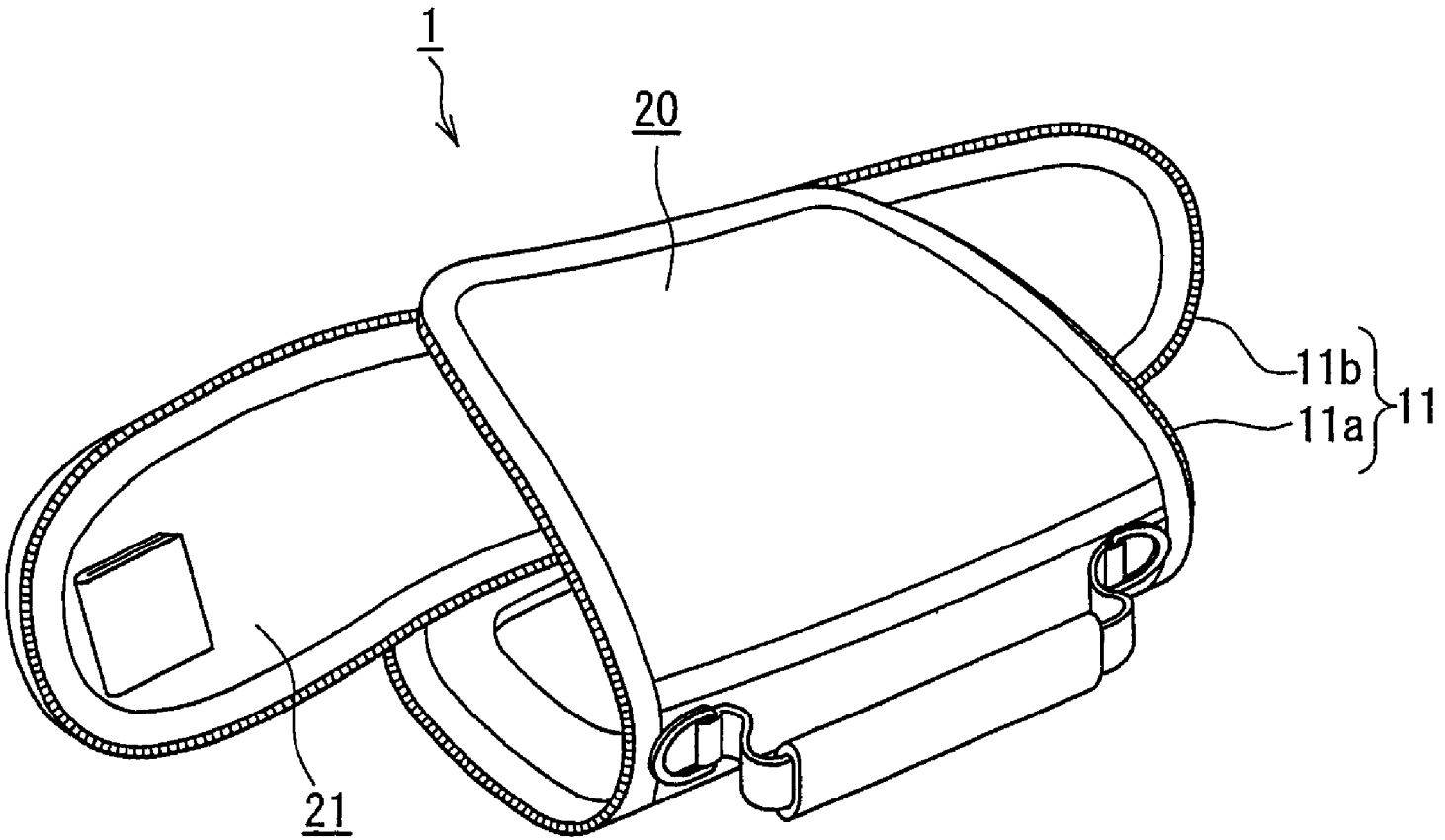
[FIG. 4]
Figure 5:
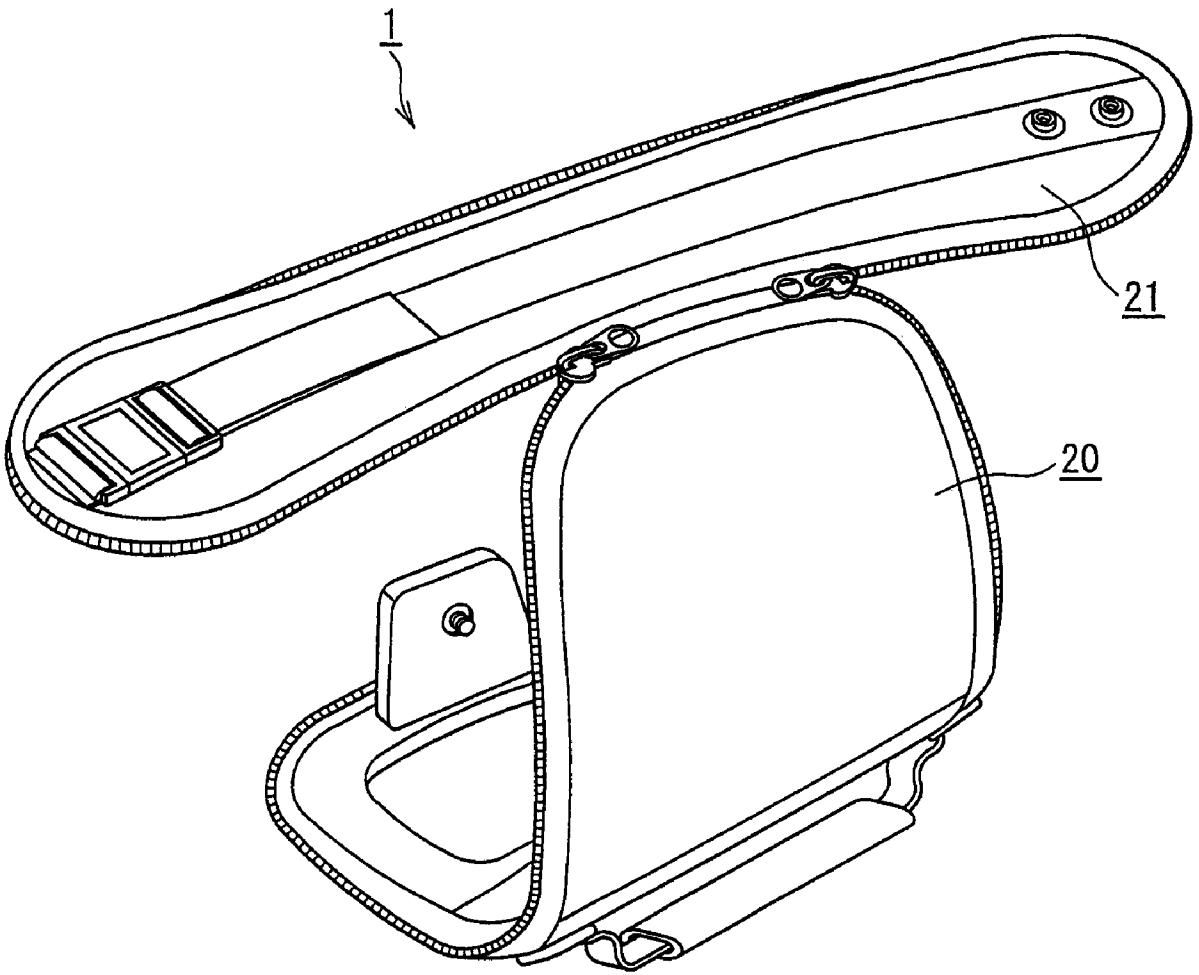
[FIG. 5]
Figure 6:
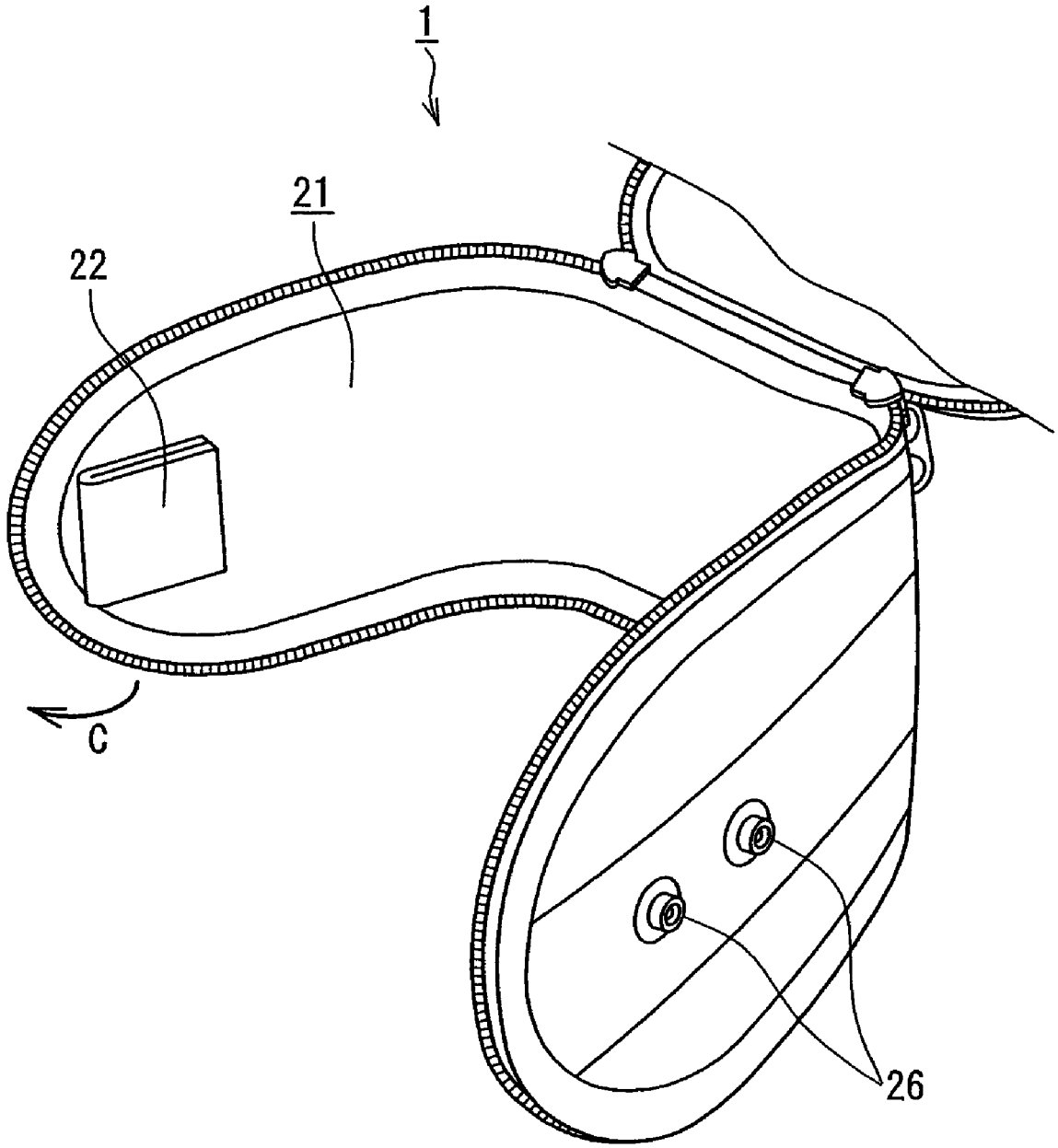
[FIG. 6]
Figure 7:
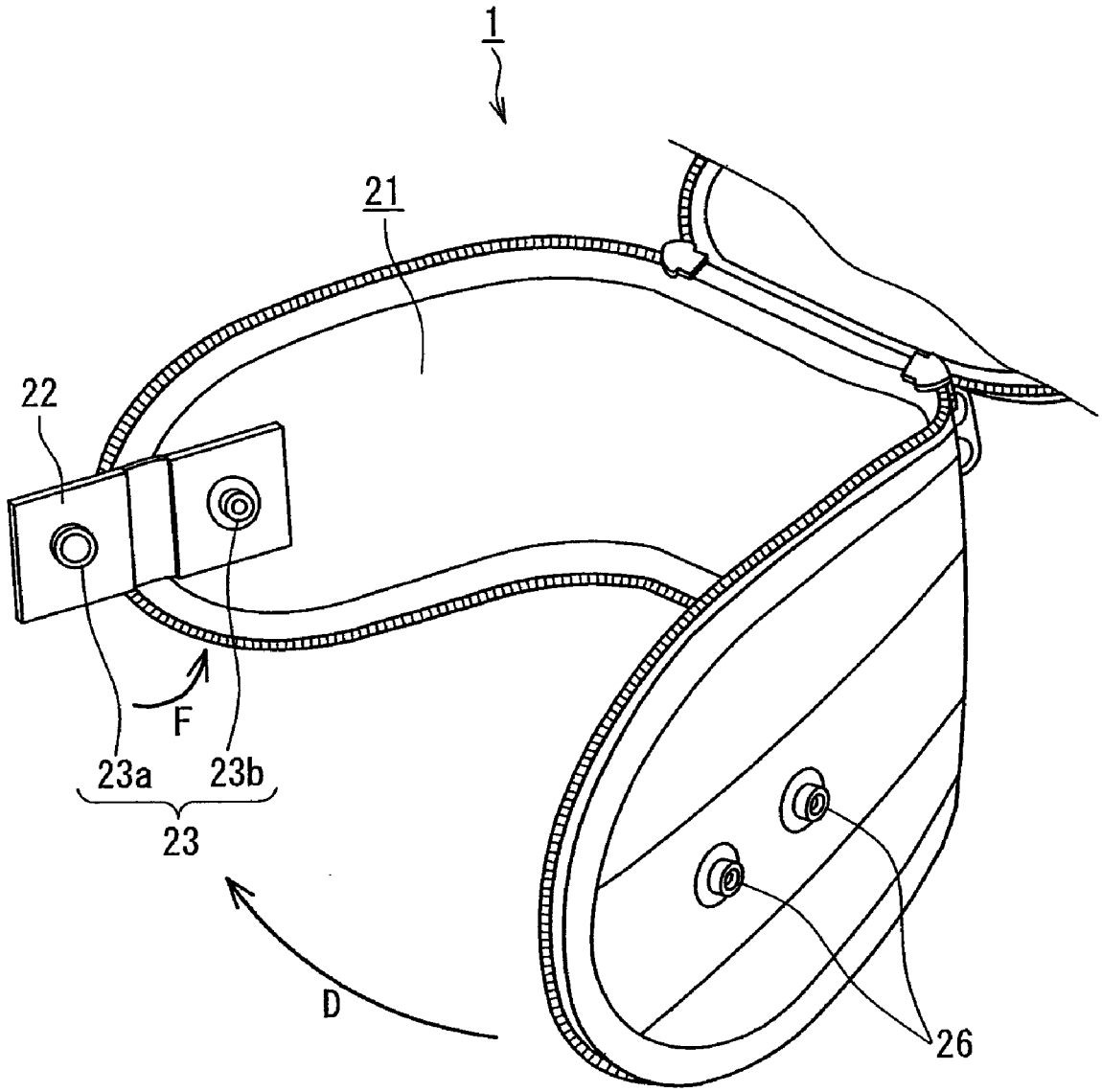
[FIG. 7]
Figure 8:
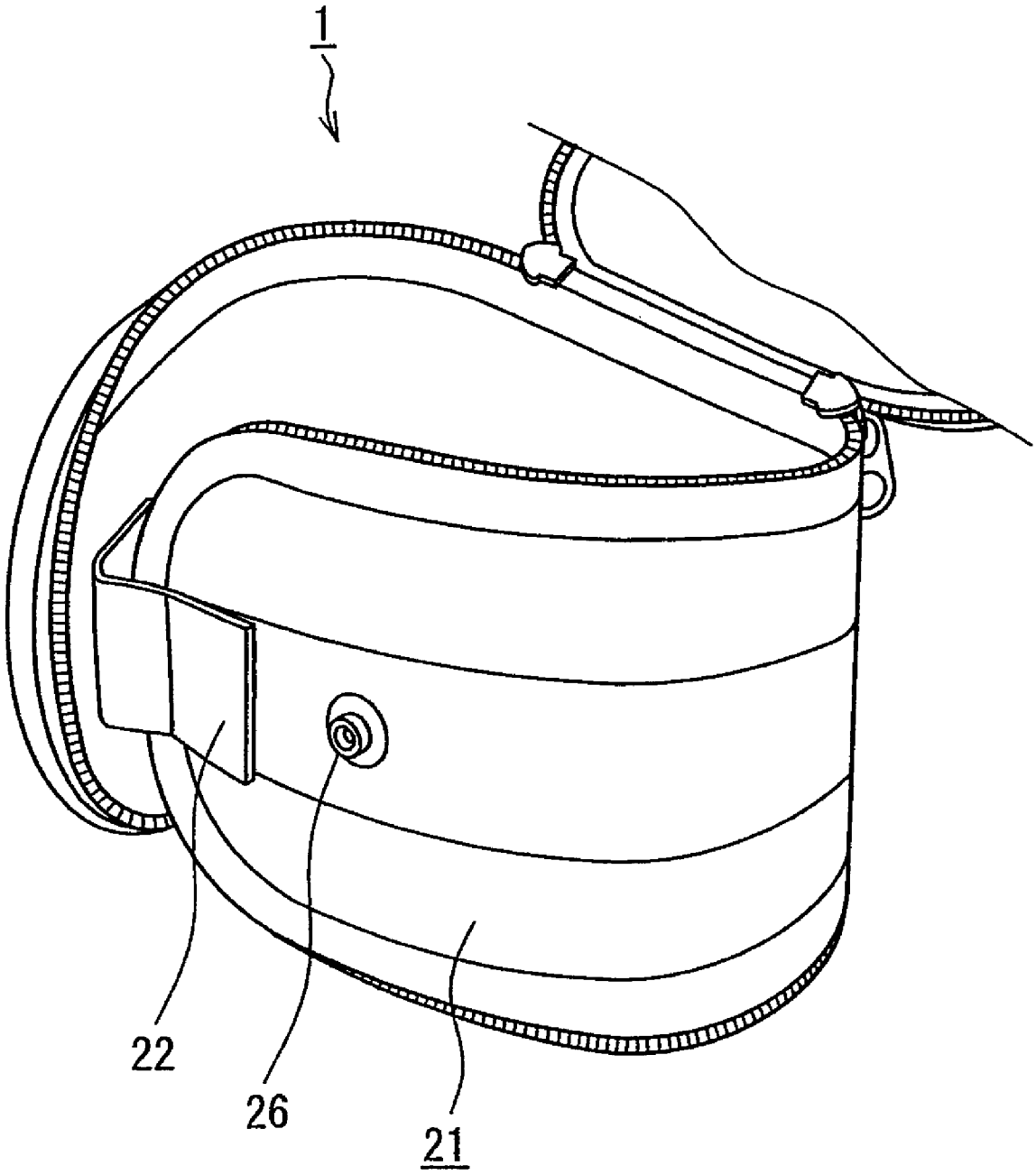
[FIG. 8]
Figure 9:
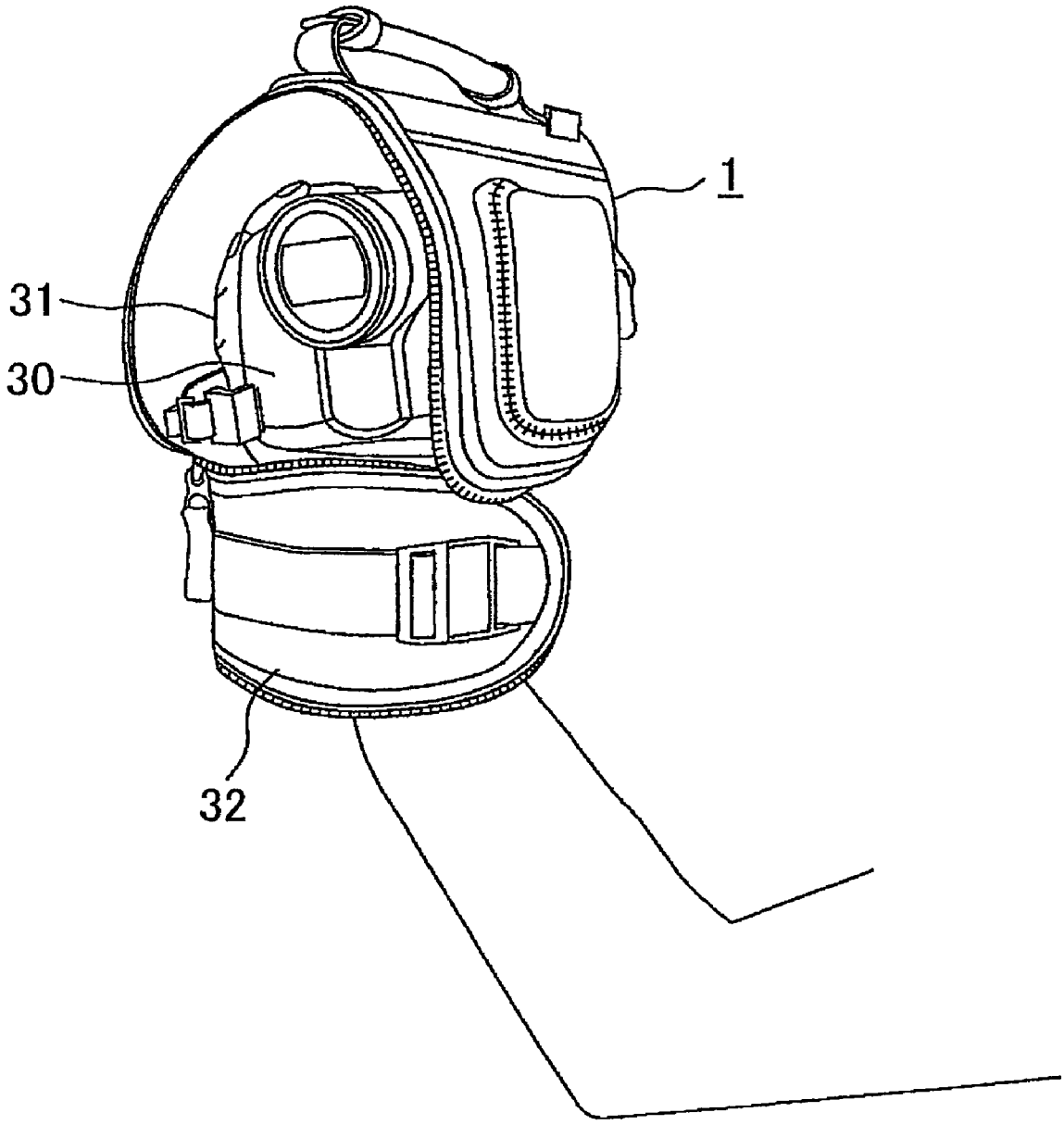
[FIG. 9]
Figure 10:
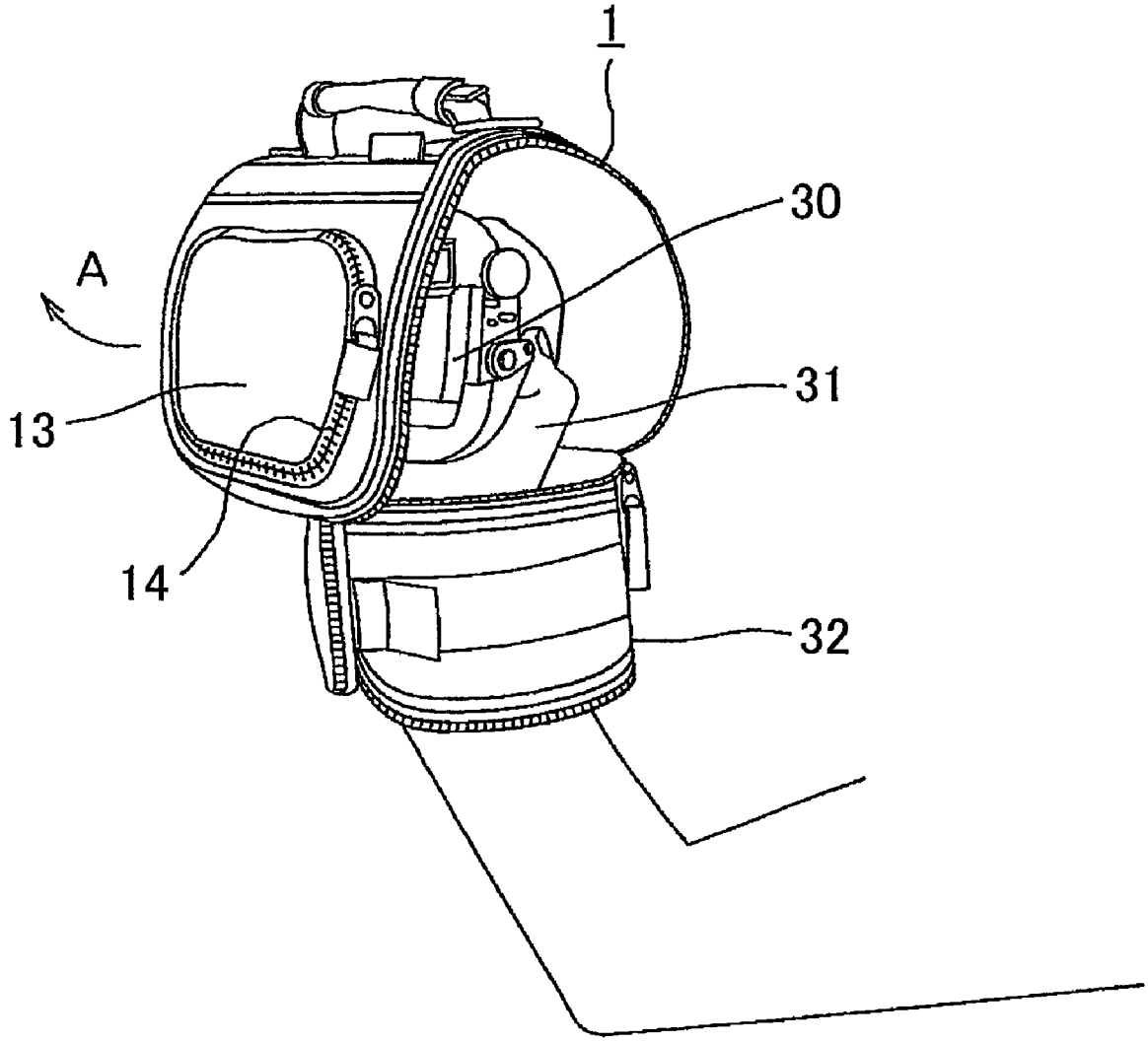
[FIG. 10]
Figure 11:
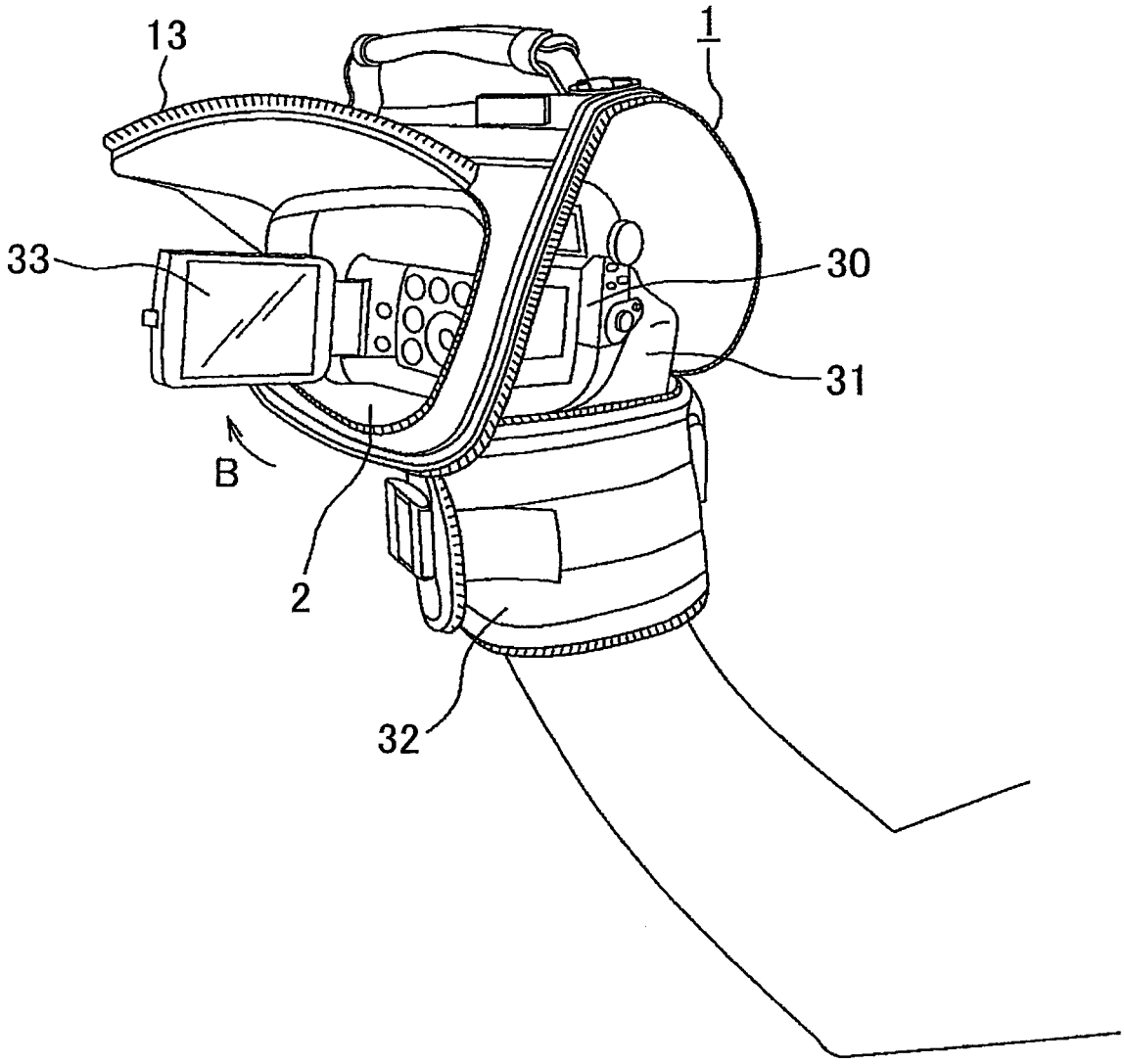
[FIG. 11]

FIG. 1 is a perspective view showing the appearance of a case according to an embodiment of the present invention when the case is in a closed state (a first state). FIG. 2 is a perspective view showing an external structure of the case in an open state (a second state). FIG. 3 is a perspective view showing an internal structure of the case in the open state. FIGS. 4 and 5 are perspective views for illustrating an opening/closing operation of the case. In FIGS. 4 and 5, a video camera body 30 held in the case 1 is not shown for the sake of simplicity in illustration. FIGS. 6 to 8 are perspective views showing main components of the case for illustrating how the case changes from the open state to a state where a second case portion 21 is wrapped (a third state). FIG. 9 is a front view showing the state where shooting is performed with a video camera housed in the case. FIG. 10 is a rear view showing the same state as FIG. 9. FIG. 11 is a perspective view showing an image pickup apparatus with its display portion being opened. It is to be noted that "external factors" as used in the following description are not limited to bad weather such as rainy weather but encompass various factors.

In FIG. 1, a case 1 is constituted by a case upper part (a first cover portion) 20 and a case bottom part (a second cover portion) 21 that will be described later and can house a video camera body 30 inside. That is, the case 1 in the state shown in FIG. 1 has a space (hereinafter referred to as a volume) large enough to house at least the video camera body 30. The outer surface of the case 1 is formed of a fabric that has been made water-repellent or waterproof. It is to be noted, however, the material of the outer surface of the case 1 is not limited to a fabric as long as it has at least a water repellency or a waterproof property, and examples thereof include flexible polymer sheets formed of condensation polymers such as polyamide and olefin-based polymers such as polyethylene. As shown in FIGS. 9 to 11, the overall size of the case 1 is designed so that, when the video camera body 30 is housed inside the case 1, images displayed on a lens and a view finder can be observed visually and the adhesion of water droplets to the lens and the view finder can be prevented when it rains etc.

A handle (a grip portion) 10 is provided at an outside of the upper part of the case 1 and the user can grip the handle 10 with his hand so as to hold the case 1 in a suspended manner. The user can carry the case 1 alone or the case 1 housing the video camera body 30 easily by gripping the handle 10 with his hand. Note here that the handle 10 is arranged on a surface of the case upper part 20 facing the bottom surface of the case bottom part 21 when the case 1 is in the first state.

A lid 13 is provided so that it can swing about a fixed portion that is fixed to a portion of a side surface of the case 1, and serves to cover an opening portion 2 provided on the side surface of the case 1. An upper edge of the lid 13 is fixed to the case 1, and the outer periphery of the lid 13 excluding the upper edge is configured so that it can be opened/dosed with respect to the case 1 by means of a fastener 14. Thus, by opening the fastener 14, the lid 13 can be swung upward, whereby the opening portion 2 is uncovered. Note here that the opening portion 2 and the lid 13 are arranged so that, when the video camera body 30 is housed in the case 1, they face the third side surface of the video camera body 30. That is, by opening the lid 13, it is possible to expose a display portion 33 of the video camera body 30 to the outside. The vertical size of the lid 13 (i.e., the amount by which the lid 13 protrudes from the case 1 when the lid 13 is in the state shown in FIG. 11) is set so that, when the display portion 33 of the video camera body 30 is swung open so as to be in the state shown in FIG. 11, the edge of the lid 13 aligns with the edge of the display portion 33, or alternatively, at least the edge of the lid 13 protrudes beyond the edge of the display portion 33.

In FIG. 2, the outer surface of the case 1 is provided with a fastener 11 composed of a pair of fastener components 11*a* and 11*b*. The pair of fastener components 11*a* and 11*b* can be joined/separated by moving a slider 12 along the fastener 11. By separating the pair of fastener components 11*a* and 11*b* in the state where the case 1 is closed, the case upper part 20 and the case bottom part 21 are separated partially (note here that the case upper part 20 and the case bottom part 21 are integrated partially by being sewn together etc.), whereby the case 1 is brought to the open state (the second state) as shown in FIGS. 2 and 3. Furthermore, by joining the pair of fastener components 11*a* and 11*b* in the state where the case 1 is open as shown in FIGS. 2 and 3, the case upper part 20 and the case bottom part 21 are integrated, whereby the case 1 is brought to the dosed state (the first state) as shown in FIG. 1.

A pair of rings 27 to/from which a shoulder belt can be attached/detached are provided near both ends of the handle 10.

In FIG. 3, the opening portion 2 is provided on the side surface of the case 1 in order to expose the display portion 33 of the video camera body 30 to the outside when the display portion 33 is swung open. The opening space of the opening portion 2 is large enough to allow at least the display portion 33 to pass therethrough.

The case upper part 20 is constituted by a continuous surface that covers the upper part and the third and fourth side surfaces of the video camera body 1 when the video camera body 30 is housed in the case 1. The peripheral edge portion of the case upper part 20 partially is fixed to the case bottom part 21, and one of the pair of fastener components, namely the fastener component 11*a*, is provided continuously along the remaining part of the peripheral edge portion. The principal plane of the case upper part 20 (the inner surface of the case 1 in the state shown in FIG. 1) is formed of a soft material so as to protect a housing of the video camera body 30 from damage when the video camera body 30 is housed in the case 1. In order further to improve the protecting ability, the case 1 may be configured so that the thickness thereof increases partially or may include a shock-absorbing pad. Furthermore, substantially at a central portion of the case upper part 20 in its longitudinal direction in the state where the case 1 is developed as shown in FIG. 2, two creases or seams are provided so as to extend in a direction substantially perpendicular to the longitudinal direction. This allows the case 1 that is in the state shown in FIGS. 2 and 3 to be bent as shown in FIG. 4. As shown in FIG. 2, the handle 10 is provided on the rear surface side of the portion between these two creases.

The case bottom part 21 is constituted by a continuous surface that covers the bottom part and the first and second side surfaces of the video camera body 1 when the video camera body 30 is housed in the case 1. The peripheral edge portion of the case bottom part 21 is fixed to the case upper part 20, and one of the pair of fastener components, namely the fastener component 11*b*, is provided continuously therein. Note here that the case upper part 20 and the case bottom part 21 are integrated, and the pair of fastener components 11*a* and 11*b* are provided continuously along the portion excluding the joint between the case upper part 20 and the case bottom part 21. The principal plane of the case bottom part 21 (the inner surface of the case 1 in the state shown in FIG. 1) is formed of a flexible material such as felt, foamed polyethylene, or flexible polyamide so as to protect the housing of the video camera body 30 from damage when the video camera body 30 is housed in the case 1.

It should be noted here that the arrangement of the pair of fastener components 11*a* and 11*b* in the present embodiment merely is an example, and other configurations also are possible. Furthermore, although the opening/closing operation (partial attachment/detachment) of the case upper part 20 and the case bottom part 21 is achieved by opening/closing the slide fastener as shown in the drawings, the case also may be configured so as to achieve this with means other than the slide fastener, such as buttons or a hook and loop fastener.

Furthermore, a pad 29 is arranged substantially at a central portion of the case bottom part 29 for protection against damage that may be caused by a screw 25. When a portion of the case bottom part 21 to be in contact with the screw 25 is formed of a material that is resistant to damage, the pad 29 may be omitted.

A rib 22 is provided in an end portion of the case bottom part 21, and it can change between the state shown in FIG. 6 and the state shown in FIG. 7 by bending. In the present embodiment, the rib 22 is substantially rectangular and is configured so that it can be bent substantially at a center thereof. In the present embodiment, the rib 22 is formed of a soft material such as fabric.

A button 23 is arranged inside the rib 22 and configured so as to be attached/detached to/from another button 26 provided at the other end of the case bottom part 21 in its longitudinal direction. In the present embodiment, on one plane of the rib 22, a male button is provided on one side and a female button is provided on the other side with respect to the bent portion, so that the male button and the female button can be joined to other by bending the rib 22. With this configuration, when the button 23 is not used, the button 23 can be covered with the rib 22 by engaging the male button with the female button, whereby the video camera body 30 can be prevented from being damaged etc. when it is housed in the case 1.

A rib 24 is provided in an end portion of the case upper part 20 that is in the longitudinal direction of the case upper part 20 and faces the joint between the case upper part 20 and the case bottom part 21.

The screw 25 (the holding member) is provided rotatably in a hole formed in the rib 24. By screwing the screw 25 in a screw hole provided in a bottom part of the video camera body 30, the case 1 and the video camera body 30 can be held and fixed to each other. The screw 25 is held so as not to be separated from the hole formed in the rib 24.

The button 26 is provided on the rear surface of the end portion facing the end portion of the case bottom part 21 having the rib 22, and can be attached/detached to/from the button 23. For example, in order to join the button 26 to the female button of the button 23, the button 26 needs to be a male button. By joining the button 26 to the button 23, the case bottom part 21 can have a ring shape as shown in FIG. 8. Although only one button 26 may be provided, providing a plurality of buttons 26 along the longitudinal direction of the case bottom part 21 is advantageous in that the inner diameter of the ring shape formed by the case bottom part 21 can be adjusted so as to be larger or smaller by selecting any one button 26 out of the plurality of buttons 26 when joining it to the button 23. That is, it becomes possible to adjust the inner diameter of the ring shape so as to conform to the thickness of the wrist or arm of the user.

A belt 28 is arranged near an end portion the outer surface of the case bottom part 21 and can hold an auxiliary container (a second case). The configuration of the auxiliary container and the operation for attaching the auxiliary container to the case 1 will be described later. Note here that it is not always necessary to provide the belt 28 and the auxiliary container.

A wrist fixing portion 32 shown in FIG. 9 is the case bottom part 21 that is formed in a ring shape. When the user holds the video camera body 30 covered with the case 1 with his hand, the user can wrap the wrist fixing portion 32 around his wrist. It is to be noted here that a portion to which the wrist fixing portion 32 is fixed is not limited to a wrist, but may be an arm or a portion near the arm.

In FIGS. 9 and 10, the video camera body 30 is one example of an image pickup apparatus that can shoot images of a subject. Although the present embodiment is directed to an example where the image pickup apparatus is a video camera, the case according to the present invention is applicable to any electronic equipment most of operations for which can be carried out with fingers of one hand holding the electronic equipment, including so-called cameras having a shooting function such as a digital video camera. In the video camera used in the present embodiment, four side surfaces excluding the upper surface and the bottom surface are constituted by: a first side surface provided with a lens; a second side surface that faces the first side surface and is provided with a view finder, a shoot button, etc.; a third side surface whose both ends are connected to the first and second side surfaces, respectively, and in which a display portion is provided in an accommodatable manner; and a fourth side surface that faces the third side surface and is to be held with a hand of the user. When the user uses the video camera body 30 with gripping it with his hand, the palm of the user is in contact with the fourth side surface, the forefinger etc. are positioned on the upper surface, and the thumb is positioned on the second side surface. It should be noted here that the configurations of the respective side surfaces of the video camera body 30 and the arrangement of the user's fingers as described above merely are shown as an illustrative example to clarify the description, and of course other configurations also are possible. Furthermore, a screw hole (not shown) as will be described later, into which the screw 25 can be screwed, is provided at the bottom part of the video camera body 30. The screw hole also is used when fixing the video camera body 30 to a tripod, for example.

As shown in FIG. 11, the display portion 33 is provided on the video camera body 30 in a swingable or accommodatable manner. In general, the display portion 33 includes a liquid crystal monitor of about 2 to 4 inches, but other configurations also are possible. The display portion 33 is configured so as to be swingable via a hinge on the video camera body 30, and the state where it is swung open is shown in FIG. 5, for example. In the state where the display portion 33 is open as shown in FIG. 5, the display portion 33 is exposed or protrudes to the outside of the case 1 through the opening portion 2. In most cases, the display portion 33 is provided independently from the view finder provided on the second side surface of the video camera body 30.

In the following description, the "first state" refers to a state where, as shown in FIG. 1, the peripheral edge portions (the pair of fastener components 11*a* and 11*b*) of the case 1 are joined so as to provide a space that can house the video camera body 30 inside the case 1. By bringing the case 1 to the first state, it becomes possible to carry the video camera body 30 easily by housing it in the case 1. The "third state" refers to a state where, as shown in FIGS. 9 to 11, the peripheral edge portions of the case 1 are separated with the video camera body 30 being held in the case upper part 20 by the holding member, so that the lens and the view finder are exposed and at least the upper part of the video camera body 30 is covered with the case upper part 20. By bringing the case 1 into the second state, it becomes possible to carry out the shooting while protecting the video camera body 30 from water droplets when it rains etc. by the case 1. The "second state" refers to a state where the case upper part 20 and the case bottom part 21 are opened by separating the joined peripheral edge portions of the case 1, as shown in FIGS. 2 and 3. By bringing the case 1 to the second state, it becomes possible to attach the video camera body 30 to the screw 25, for example.

Hereinafter, operations of the case according to the present embodiment configured as above will be described.

First, the first state of the case will be described.

When the video camera body 30 is not used, the video camera body 30 can be housed in the case 1, and the fastener 11 is closed so as to bring the case 1 in the form like a bag as shown in FIG. 1. In this state, it is possible to carry the video camera body 30 easily and comfortably by gripping the handle 10 with a hand.

When taking the video camera body 30 out of the case 1, the slider 12 is moved along the fastener 11 in FIG. 1 so as to open the fastener 11 to achieve the second state as shown in FIG. 4, whereby the inside of the case 1 is opened as shown in FIGS. 2 and 3. In the state as shown in FIGS. 2 and 3, the video camera body 30 can be housed in the case 1 or taken out of the case 1.

Next, the third state (where the case is used as a rain shield during shooting) will be described.

By moving the slider 12 along the fastener 11 when the case is in the first state shown in FIG. 1(the state where the video camera body 30 is not housed in the case 1), the fastener 11 can be opened as shown in FIG. 4 to achieve the second state.

The case 1 can change from the second state shown in FIG. 4 to the state shown in FIGS. 2 and 3 by moving the case upper part 20 and the case bottom part 21 as shown in FIG. 5.

In the present embodiment, as shown in FIGS. 2 and 3, the fastener 11 is provided continuously along the peripheral edge portion of each of the case upper part 20 and the case bottom part 21 excluding the fixing portion where they are joined to each other. Thus, by moving the slider 12 from one end to the other end of the fastener 11 continuously, it is possible to achieve the state shown in FIGS. 2 and 3 (i.e., the state where the inside of the case 1 is opened).

Next, in FIGS. 2 and 3, the screw 25 provided in the rib 24 is screwed in the screw hole (not shown) provided in the bottom part of the video camera body 30. At this time, the video camera body 30 is arranged so that the third side surface having the display portion 33 faces the opening portion 2.

Next, the video camera body 30 is covered with the case 1 in such a manner that the upper surface, the third side surface, and the fourth side surface of the video camera body 30 are covered with the case upper part 20 and the case bottom part 21.

Next, a hand 31 of the user is passed through a grip belt provided on the fourth side surface of the video camera body 30, and the video camera body 30 is held by the user's hand 31. The video camera body 30 may be covered with the case upper part 20 after the user's hand has passed through the grip belt.

Next, with the video camera body 30 being held by the user's hand 31, the case bottom part 21 is wrapped around the user's wrist and then the button 23 and the button 26 are joined to each other. That is, in the case bottom part 21 that is in the state shown in FIG. 6, the rib 22 is first swung in the direction indicated by an arrow C to separate the button 23*a* from the button 23*b* to expose the button 23 as shown in FIG. 7. Thereafter, the case bottom part 21 is bent in the direction indicated by an arrow D so as to wrap the case bottom part 21 around the user's wrist, and then the button 23*a* and the button 26 are joined to each other as shown in FIG. 8. In the present embodiment, two buttons 26 are provided, and the button 23*a* may be joined to either one of the buttons 26. By joining the button 23 to either one of the buttons 26, the inner diameter of the wrist fixing portion 32 can be set to an arbitrary size conforming to the thickness of the user's wrist.

In the above-described manner, the wrist fixing portion 32 is formed by the case bottom part 21 as shown in FIGS. 9 and 10. The wrist fixing portion 32 is held at the user's wrist, and accordingly, the case 1 is held at the user's wrist.

Since the first side surface (the surface provided with the lens) of the video camera body 30 is exposed as shown in FIG. 9, it is possible to shoot the subject. Moreover, since the second side surface (the surface provided with the viewfinder) of the video camera body 30 also is exposed as shown in FIG. 10, the operator of the video camera body 30 visually can recognize the obtained image signals by looking through the view finder. The second side surface also has operating portions that generally are operable with the thumb of the operator, such as a shoot button and a power button. Through these operating portions, it is possible to perform operations such as turning on/off the video camera body 30 and starting/finishing the shooting. In the present embodiment, the video camera body 30 has a zoom switch for controlling telephoto/wide-angle shot of a subject image on its upper surface. The zooming operation can be performed properly since a clearance large enough to accommodate the user's fingers is provided between the upper surface of the video camera body 30 and the inner surface of the case 1 in the state shown in FIGS. 9 and 10.

As shown in FIG. 10, the shooting style is not limited to the one performed while looking the image being shot that is displayed on the view finder provided on the second side surface of the video camera body 30, and it is also possible to perform shooting while looking the image being shot that is displayed on the display portion 33 provided on the video camera body 30 in an accommodatable manner.

In order to bring the display portion 33 that is in the state shown in FIGS. 9 and 10 to a usable state, the fastener 14 is opened first. Then, the lid 13 is separated from the case upper part 20, thus allowing the lid 13 to be swung in the direction indicated by an arrow A. When the lid 13 is thus swung open, the opening portion 2 appears as shown in FIG. 11.

Next, the display portion 33 housed in the video camera body 30 is swung in the direction indicated by an arrow B. The display portion 33 protrudes to the outside of the case 1 through the opening portion 2 as shown in FIG. 11. In this state, the lid 13 extends substantially horizontally above the display portion 33, so that the lid 13 can prevent rainwater and the like from adhering to the display portion 33. A display surface of the display portion 33 can face toward the operator by bringing it to the state shown in FIG. 11. Thus, when the video camera body 30 enters the shooting mode, it is possible to perform the shooting of a subject while looking the display surface of the display portion 33.

In FIG. 11, although the lid 13 moves downward by its own weight, the lid 13 is brought into contact with the upper part of the display portion 33, whereby a predetermined open-lid state can be maintained. Moreover, when the joint between the lid 13 and the case 1 has a configuration that can prevent the lid 13 from moving downward (e.g., when the surface of an end portion of the upper surface of the lid 13 and the side surface of the case 1 are sewn together), a more stable open-lid state can be maintained.

The change from the state shown in FIG. 11 to the state shown in FIG. 1 can be achieved by swinging the display portion 33 so as to be housed in the video camera body 30 and then closing the lid 13. Thereafter, as shown in FIGS. 9 and 10, the fastener 14 is closed.

Next, the joining between the button 23 and the button 26 in the wrist fixing portion 32 shown in FIGS. 9 and 10 is released, and the arm and the hand 31 of the user are withdrawn from the wrist fixing portion 32. Specifically, in the case bottom part 21 that is in the ring shape as shown in FIG. 8, the button 23 and the button 26 (both are not shown) are separated from each other, thus achieving the state shown in FIG. 7.

Next, the rib 22 is swung in the direction indicated by an arrow F, and then the button 23*a* and the button 23*b* are joined to each other as shown in FIG. 6.

Thereafter, the case 1 is changed to the state shown in FIG. 4 through the state shown in FIG. 5, whereby the case bottom part 21 faces the bottom part of the video camera body 30. Then, the fastener 11 is closed by moving the slider 12 (see FIG. 1) along the fastener 11.

Thus, the case 1 can be changed to the non-use state shown in FIG. 1 with the video camera body 30 being held in the case 1. As shown in FIG. 1, since the handle 10 is provided on the upper surface of the case 1, the user can carry the case 1 that houses the video camera body 30 favorably by gripping the handle 10.

As described above, the case according to the present embodiment can serve both as a so-called housing case for housing and carrying the video camera body 30 and also as a rain shield to be used during shooting so as to allow the video camera body 30 to be used in the rain or the like. This eliminates the necessity of bringing both a housing case and a snow/rain jacket as in the prior art, and hence, the case according to the present embodiment has excellent portability.

Moreover, because the side surface of the case 1 has the opening portion 2 and the lid 13 for covering the opening portion 2, it becomes possible to perform shooting in the rain or the like while looking the display portion 33 that is provided on the video camera body 30 in an accommodatable or swingable manner.

Furthermore, the case is configured so that the user's wrist is held by the wrist fixing portion 32, it is possible to stabilize the case 1 and the video camera body 30 during shooting and to decrease the load on the user's hand and wrist during shooting.

Furthermore, in the present embodiment, the case is configured so that the button 23 and the button 26 are joined to each other when forming the case bottom part 21 in the ring shape to provide the wrist fixing portion 32. However, the joining means is not limited to buttons, and any other configurations also are applicable. For example, with the use of a hook and loop fastener, it becomes possible to perform an engaging/releasing operation easily and also to perform fine adjustment of the inner diameter of the wrist fixing portion 32 to an arbitrary size.

Furthermore, although the lid 13 is configured so that it can be opened and closed with respect to the case upper part 20 with the fastener 11, this can be achieved by means other than the slide fastener.

Figure 12:
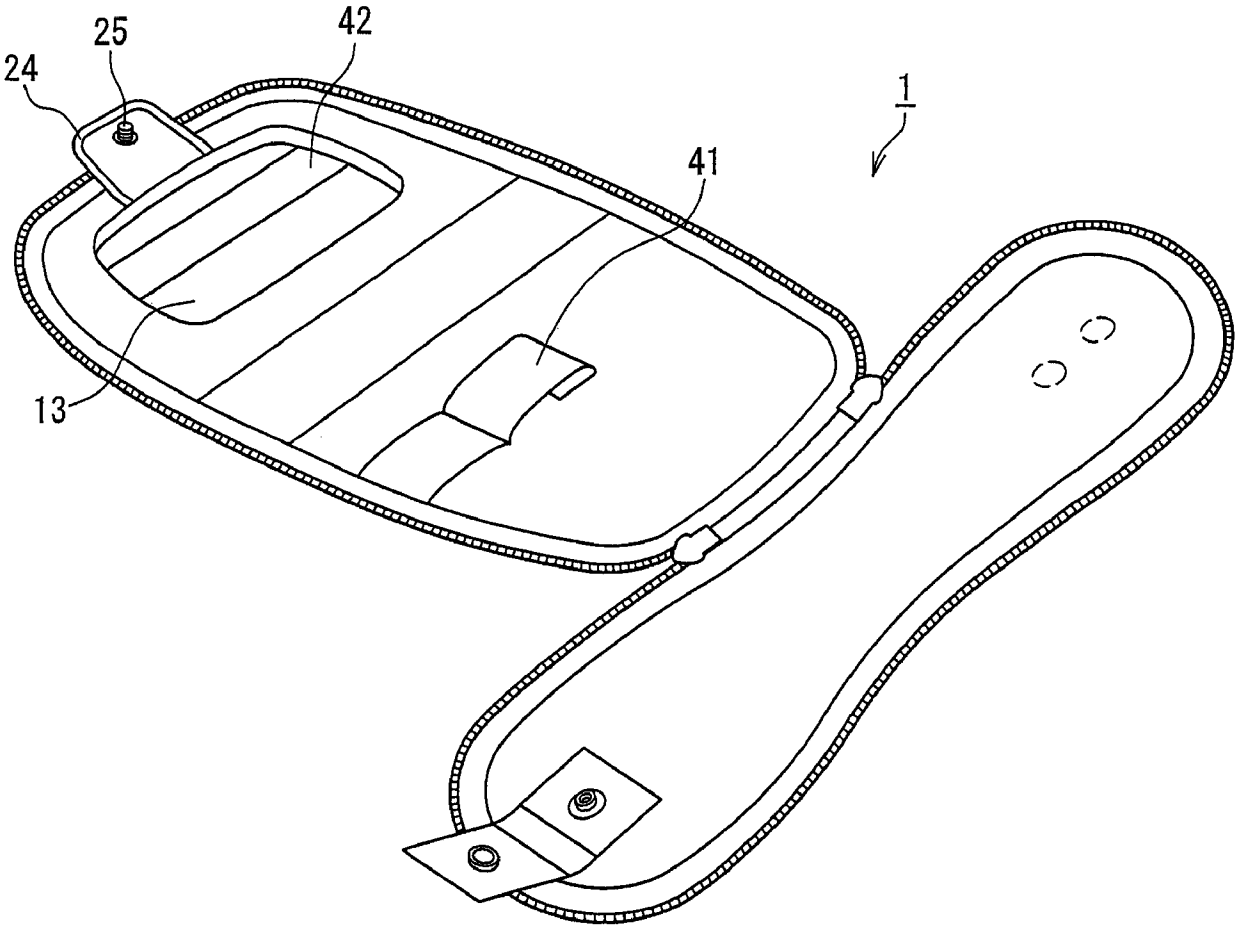
[FIG. 12]

Furthermore, the case 1 may have a configuration as shown in FIG. 12. FIG. 12 is a perspective view showing another configuration of the case 1. FIG. 12 shows the developed state of the case 1.

In FIG. 12, a belt 41 (a supporting member) is provided on an inner surface of the case upper part 20. The belt 41 can hold the user's fingers when the user holds the video camera body 30 housed in the case 1 with his hand. With this configuration, in the second state as shown in FIG. 9 etc., the conformity of the case upper part 20 with the external shape of the video camera body 30 is improved, which allows the video camera body 30 to be held stably. Moreover, for example, when a wind gust occurs or when the orientation of the video camera body 30 is changed abruptly, the possibility that part of the case upper part 20 may cover the lens portion to hinder the shooting is eliminated.

Furthermore, as shown in FIG. 12, the inner surface of the lid 13 may have a screw housing member (a housing member) 42. The screw housing member 42 can be formed of a material that deforms elastically, such as a rubber-like band made of fabric, for example. The screw 25 provided in the rib 24 can be housed by being sandwiched between the screw housing member 42 and the lid 13. Thus, the head of the screw 25 can be covered with the screw housing member 42, so that it is possible to prevent the inner wall of the case 1, the housing of the video camera body 30, etc. from being damaged by the head of the screw 25.

Figure 13:
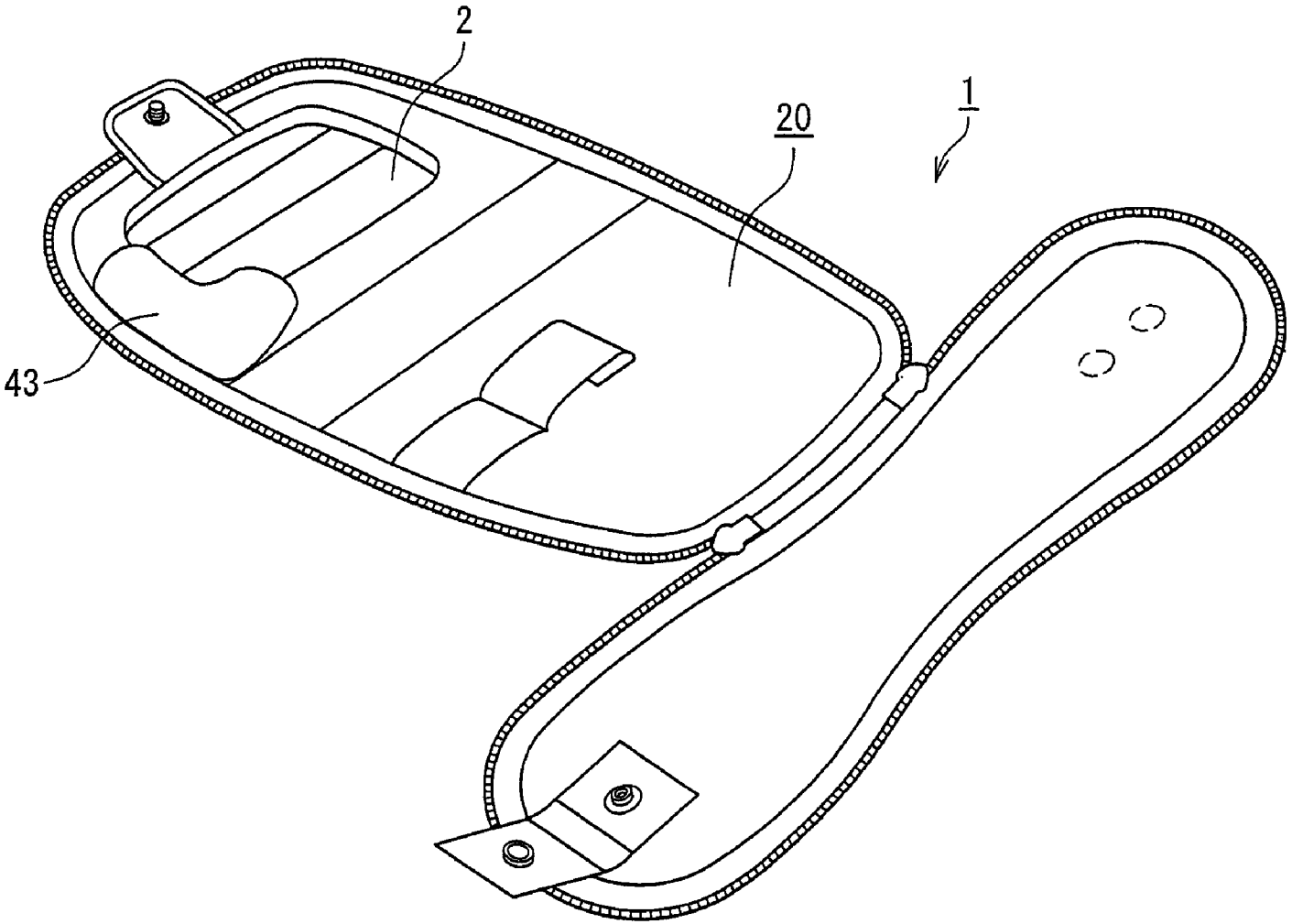
[FIG. 13]
Figure 14:
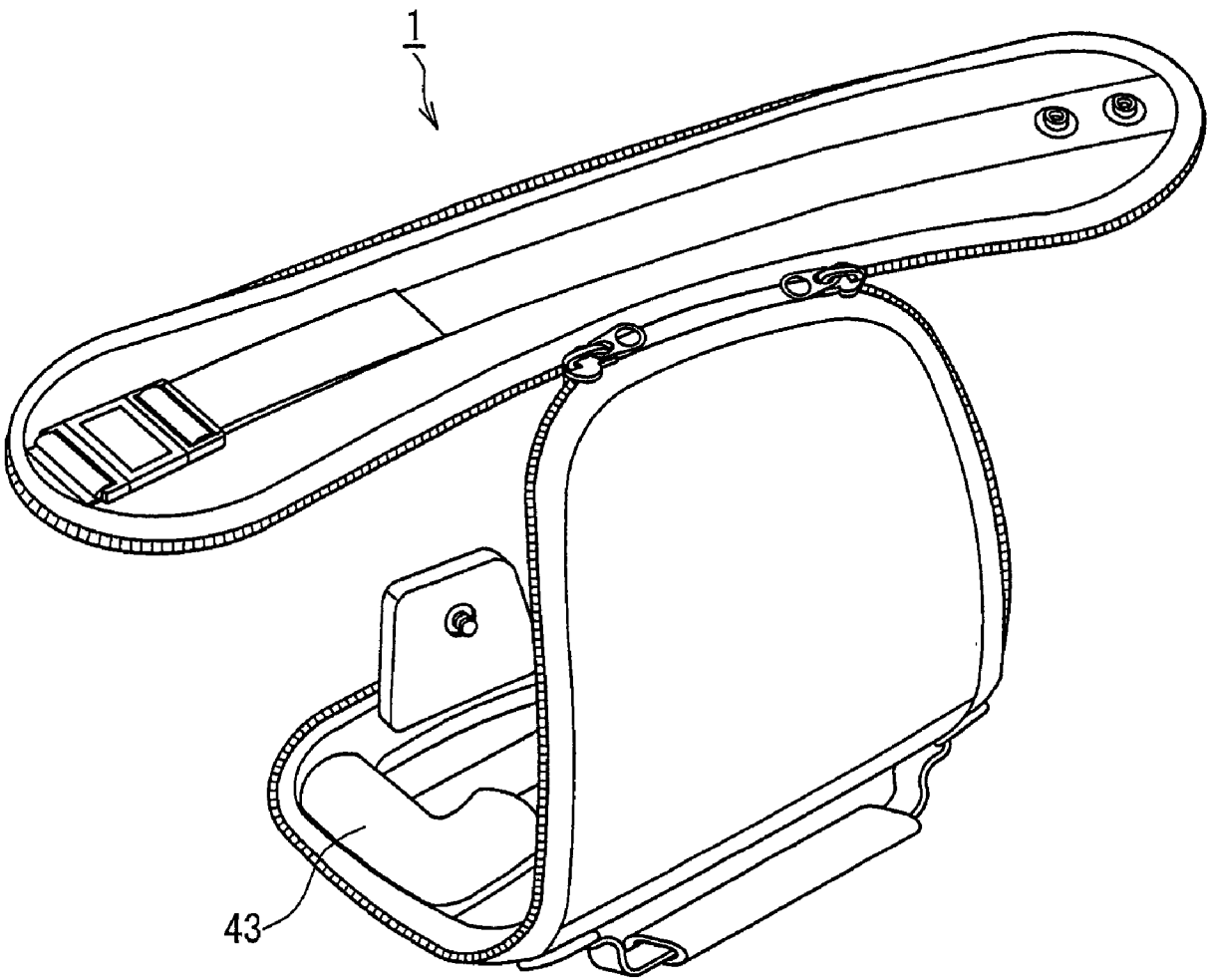
[FIG. 14]
Figure 15:
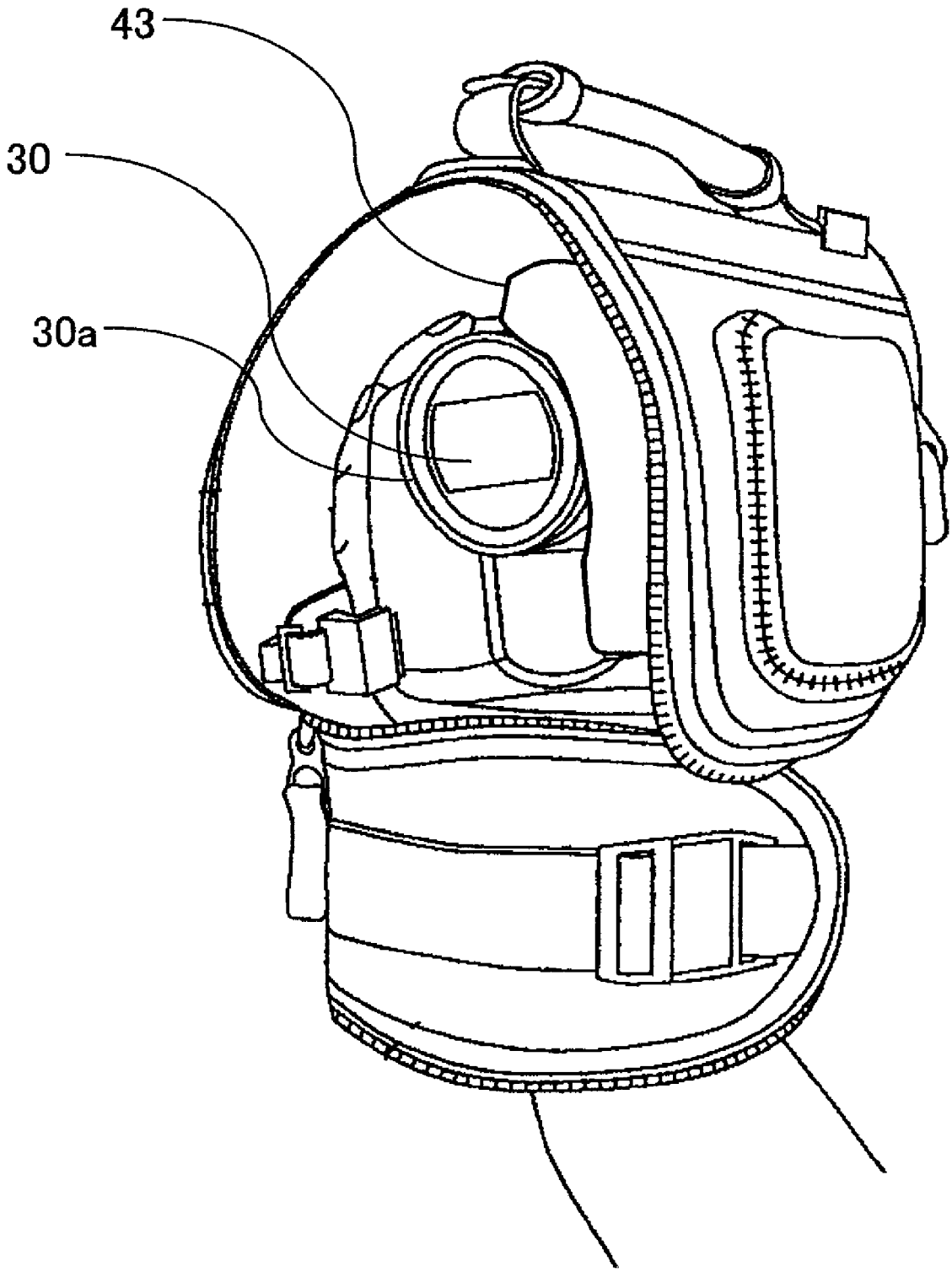
[FIG. 15]

Alternatively, the case 1 may have a configuration as shown in FIG. 13. FIG. 13 is a perspective view showing another configuration of the case 1. FIG. 13 shows the second state where the case 1 is developed. FIG. 14 is a perspective view showing the case that is in the state where the case bottom part 21 is moved. FIG. 15 is a front view showing the video camera body 30 housed in the case 1 as viewed from the front. Note here that FIG. 15 only shows the video camera body 30 and a lens barrel supporting member 43 for the sake of simplicity in illustration.

In FIGS. 13 and 14, the lens barrel supporting member 43 is provided near the opening portion 2 on the inner surface of the case upper part 20. The lens barrel supporting member 43 is formed of an elastic material and has a large thickness. For example, it is formed of a fabric cover filled with a cushioning material such as cotton.

The lens barrel supporting member 43 is arranged so that, when the video camera body 30 is fixed to the case 1, a lens barrel 30*a* of the video camera body 30 is in contact with the lens barrel supporting member 43 as shown in FIG. 15. This allows the horizontal oscillation of the video camera body 30 to be suppressed when the video camera body 30 is gripped with the user's hand as shown in FIG. 11.

Although the lens barrel supporting member 43 shown in FIG. 13 is formed in a substantially L-shape along the edge of the opening portion 2, it may have other shape or arrangement as long as it is in contact with part of the video camera body and does not hinder the swinging operation of the display portion 33 (see FIG. 11). Moreover, the lens barrel supporting member 43 may be configured so as to be attachable/detachable to/from the case 1. For example, it may be configured so as to be attachable to an arbitrary position of the case 1 with a hook and loop fastener. Furthermore, the portion of the video camera body 30 with which the lens barrel supporting member 43 is in contact is not limited to the lens barrel but may be any portions other than the lens barrel.

Figure 16:
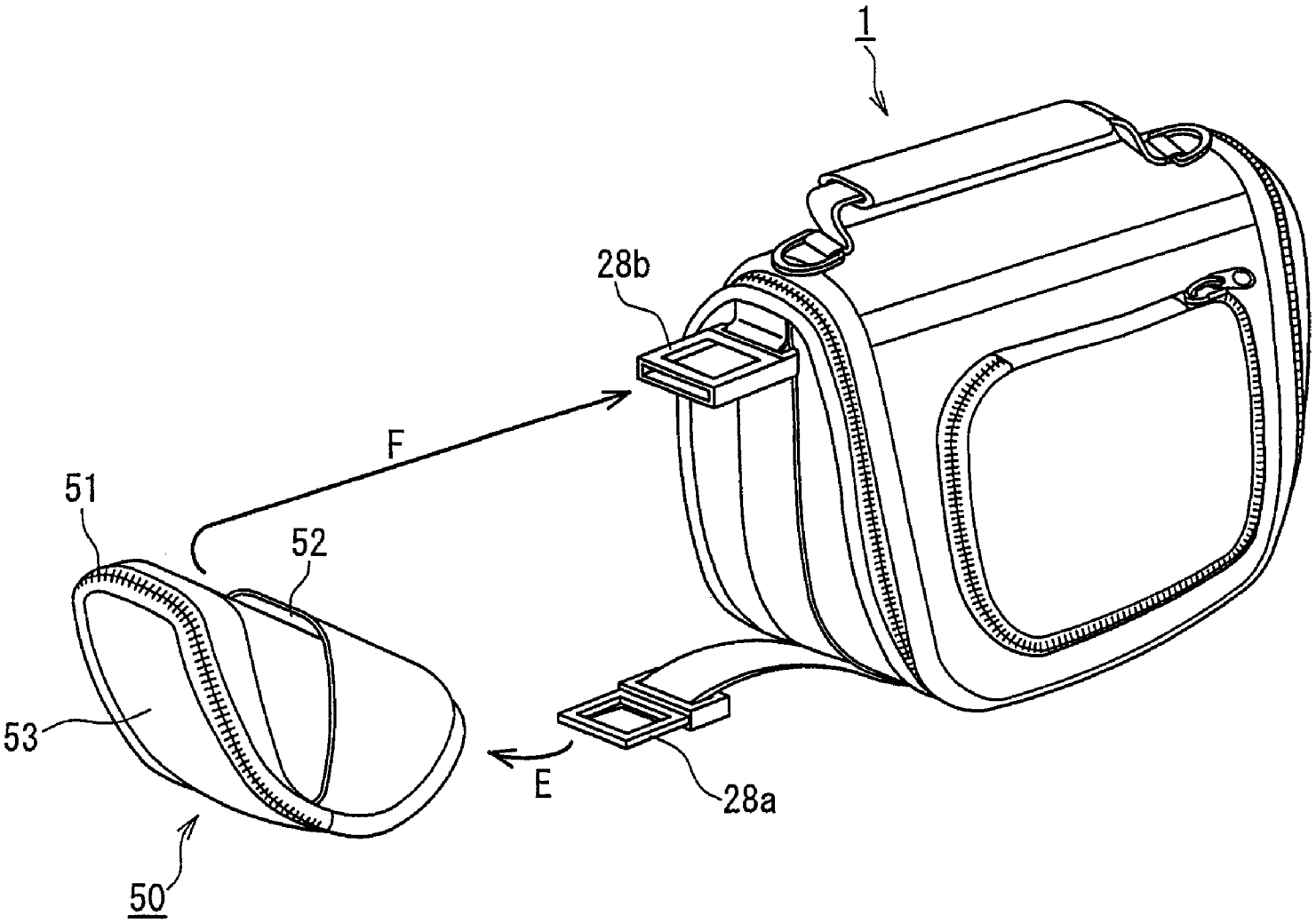
[FIG. 16]
Figure 17:
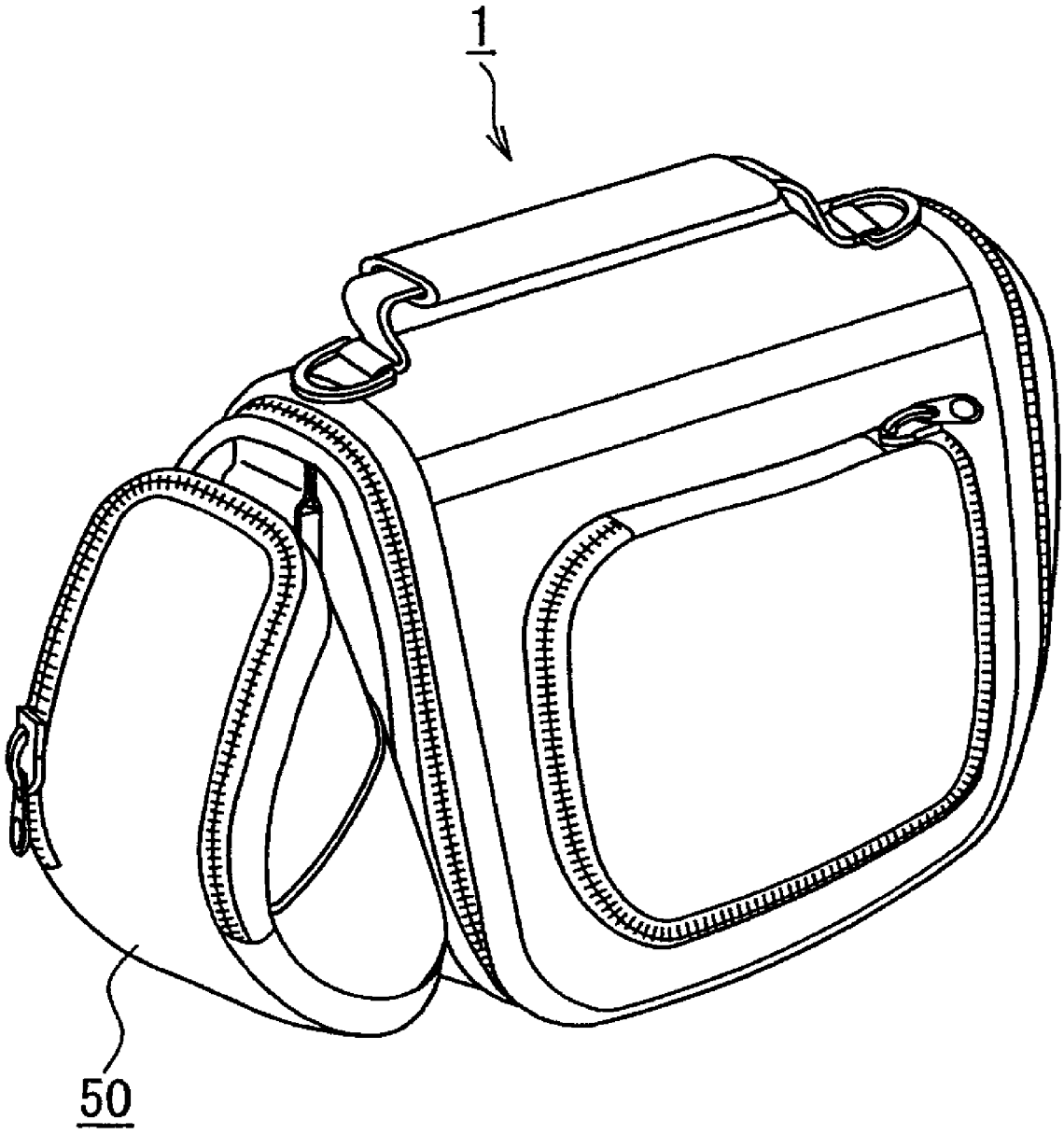
[FIG. 17]

As shown in FIGS. 16 and 17, the case may be configured so that the auxiliary container (the second case) 50 can be attached/detached to/from the belt 28 (see FIG. 1) provided the case bottom part 21. The auxiliary container 50 has a volume large enough to house accessories such as a battery and a tape cassette. The auxiliary container 50 is configured so that a lid 53 can be opened/closed with a fastener 51. The auxiliary container 50 has a supporting portion 52 through which the belt 28 can pass.

When attaching the auxiliary container 50 to the case 1, in FIG. 16, a pair of clamps 28*a* and 28*b* provided in the belt 28 are separated from each other, and the clamp 28*a* is passed through the supporting portion 52 as indicated by an arrow E. Then, by fitting the clamp 28*a* in the clamp 28*b*, the auxiliary container 50 can be attached to the case 1 as shown in FIG. 17.

Note here that the auxiliary container 50 can be detached from the case 1 by performing the above-described processed in inverse order.

INDUSTRY APPLICABILITY

The present invention is applicable to a case having a function of preventing the adhesion of water droplets to an image pickup apparatus when shooting is performed under circumstances where water droplets may adhere to the image pickup apparatus, such as rainy weather or the like.

The invention claimed is:

1. A case comprising:

a first cover portion; and a second cover portion, an outer periphery of the first cover portion and an outer periphery of the second cover portion are fixed to each other at a joint, wherein the case changes among a first state where the outer peripheries of the first cover portion and the second cover portion are joined to each other so as to provide a space inside, a second state where the outer peripheries of the first cover portion and the second cover portion are separated from each other so that the outer peripheries as a whole assume a substantially T-shape, and a third state where joining members provided at both ends of the second cover portion via the joint are joined to each other so that the second cover portion has a ring shape.

2. The case according to claim 1, wherein the space provided in the first state can house an image pickup apparatus that comprises:

a front surface where a lens through which an optical image enters is exposed;

a rear surface facing the front surface;

a first side surface connected to the front surface and the rear surface;

a second side surface facing the first side surface; and an upper surface and a bottom surface that are connected to the front surface, the first side surface, and the second side surface.

3. The case according to claim 2, wherein, in the first state, the first cover portion covers at least the upper surface and the second cover portion covers at least the lens.

4. The case according to claim 2, wherein the second cover portion in which the joining members are joined to each other so that the second cover portion has the ring shape in the third state is wrapped around an arm or a portion near the arm of an operator of the image pickup apparatus.

5. The case according to claim 2, wherein the first side surface or the second side surface has a display portion that reproduces the optical image that has entered through the lens, and the first cover portion has an opening portion through which the optical image reproduced by the display portion can be recognized visually in the second state or the third state at a position corresponding to the display portion.

6. The case according to claim 5, further comprising a lid that covers the opening portion and is partially fixed to the first cover portion, wherein the lid can be opened/closed with respect to the first cover portion and covers an upper part of the display portion when the lid is opened with respect to the first cover portion.

7. The case according to claim 2, wherein the first cover portion comprises a holding member that can hold the image pickup apparatus.

8. The case according to claim 7, wherein the first cover portion comprises a housing member that can house the holding member.

9. The case according to claim 1, wherein a grip portion that can be gripped so as to hold the first cover portion and the second cover portion in a suspended manner is provided on a surface of the first cover portion facing a bottom surface of the second cover portion in the first state.

10. The case according to claim 1, wherein the first cover portion comprises a supporting member with which an operator of the image pickup apparatus can support the first cover portion.

11. The case according to claim 1, wherein the first cover portion comprises a lens barrel supporting member that supports a lens barrel of the image pickup apparatus.

12. The case according to claim 1, wherein an attachment member with which a second case is engaged in a detachable manner is provided on an outer surface of the second cover portion.

13. The case according to claim 4, wherein the first side surface or the second side surface has a display portion that reproduces the optical image that has entered through the lens, and the first cover portion has an opening portion through which the optical image reproduced by the display portion can be visually recognized in the second state or the third state at a position corresponding to the display portion.

14. The case according to claim 13, further comprising a lid that covers the opening portion and is partially fixed to the first cover portion, wherein the lid can be opened/closed with respect to the first cover portion and covers an upper part of the display portion when the lid is opened with respect to the first cover portion.

* * * * *